United States Patent [19]

Schubert et al.

[11] 4,220,274

[45] Sep. 2, 1980

[54] DEVICE FOR FEEDING YARN IN TEXTILE MACHINES

[75] Inventors: Frank Schubert; Manfred Schneider, both of Karl-Marx-Stadt, German Democratic Rep.

[73] Assignee: Textima Veb Wirkmaschinenbau, Karl-Marx-Stadt, German Democratic Rep.

[21] Appl. No.: 44,332

[22] Filed: May 31, 1979

[30] Foreign Application Priority Data

Jun. 2, 1978 [DD] German Democratic Rep. ... 205747

[51] Int. Cl.[2] ..... B65H 51/30; B65H 59/10

[52] U.S. Cl. ..... 226/34; 66/132 R; 66/146; 226/168; 226/188; 226/195; 242/45; 242/47.01; 242/47.08; 242/147 R; 242/149

[58] Field of Search ..... 226/195, 10, 11, 24, 226/34, 44, 168, 188; 242/45, 47.01, 47.08, 47.09, 147 R, 149, 47.12; 66/132 R, 146

[56] References Cited

U.S. PATENT DOCUMENTS

| | | | |
|---|---|---|---|
| 2,160,495 | 5/1939 | Francis | 242/45 |
| 2,217,225 | 10/1940 | Lawson et al. | 66/132 R |
| 2,269,299 | 1/1942 | Wiggins | 242/45 |
| 2,399,403 | 4/1946 | Pierre | 66/132 R X |
| 2,441,118 | 5/1948 | Boucraut | 66/132 R |
| 2,641,913 | 6/1953 | Alric | 242/47.09 X |
| 2,917,914 | 12/1959 | Shortland | 242/147 R X |
| 3,083,924 | 4/1963 | Vossen et al. | 242/47.12 |
| 3,093,330 | 6/1963 | Schmidt | 242/45 |
| 3,323,753 | 6/1967 | Spurgeon | 242/147 R |
| 3,831,873 | 8/1974 | Bense | 242/45 |

*Primary Examiner*—Stanley N. Gilreath
*Attorney, Agent, or Firm*—Michael J. Striker

[57] ABSTRACT

The device for feeding yarn in a textile machine comprises a set of feed driving rollers rotating at a speed exceeding the maximum yarn processing speed in the machine, a first yarn brake downstream of the driving rollers, a first swing support upstream of the rollers, a second yarn brake and a second swing support. Each swing support includes a movable member exerting by its weight a tension against the yarn which causes the latter to engage frictionally the driving rollers. The frictional force exceeds the force of the first yarn brake and advances the yarn about a length which is sufficient to cause the moving member of the first swing support to abut against a fixed stop member so that the tension is released from the yarn and the holding friction changes to a sliding friction which is lower than the braking force of the first brake and thus stops the decoiling of the yarn.

10 Claims, 3 Drawing Figures

DEVICE FOR FEEDING YARN IN TEXTILE MACHINES

BACKGROUND OF THE INVENTION

This invention relates in general to a textile machine and in particular it relates to a device for feeding threads or yarns, especially bands of yarns, into a textile machine equipped with feed-drive rollers around which the fed yarn is partially or completely wound and which have a circumferential speed which exceeds the average yarn processing speed in the machine whereby a first yarn brake is arranged between the drive rollers and the yarn bobbin and a second yarn brake is arranged between the processing part of the machine and the feed drive rollers.

From the German Pat. No. 649,373, a yarn feeding arrangement is known for use in hosiery or knitting machines, which has a feed drive roller around which respective yarns are wound. This drive roller is driven at a speed which is higher than the maximum speed at which the yarn is to be fed. The yarn wound around the driving roller engages the latter proportionally to the increase of the yarn tension to be advanced at an increasing speed whereas at a decreasing tension of the yarn the latter contacts the roller more loosely and due to the resulting slip it is advanced more slowly. A plate brake is at the same time arranged both upstream and downstream of the feed driving roller in order to brake with a predetermined force the yarn portion before and after the roller.

The disadvantage of this prior-art solution lies in the fact that the yarns are subject to tensions depending on the particular loop processing arrangement of the machine, and tension variations in the yarn take place between the needles and the feed driving roller. These variations are additionally amplified during the reaction time necessary for feeding the yarn at the required speed. As a consequence, the tension variations in the yarn influence adversely the quality of the formed loop patterns and may even cause the breaking of the yarn.

Another disadvantage of this known feeding device is to be seen in the necessity of providing a separate feeding driving roller for each yarn. This arrangement, particularly in the case of a band of yarns results in extremely high technological and economical expenditures.

SUMMARY OF THE INVENTION

It is, therefore, a general object of the present invention to overcome the aforementioned disadvantages.

More particularly, it is an object of the invention to provide an improved yarn feeding device for textile machines which makes the tension on individual yarns uniform and thus increases the quality of the product manufactured in the textile machine and at the same time decreases the manufacturing cost of the yarn feeding device.

Another object of this invention is to provide such an improved feeding device which feeds each individual yarn in a plurality or band of yarns at a continuously uniform tension even when respective yarns are processed at different speeds and withdrawn from the supply body under different conditions.

In keeping with these objects, and others which will become apparent hereafter, one feature of the invention resides, in a device for feeding preferably a band of yarns into a textile machine, in the provision of at least one driving roller having a circumferential speed exceeding the processing speed of the yarns in the machine, means for guiding the yarn at least partially around the circumference of the driving roller, a first yarn brake arranged upstream of the rollers, a swing support assigned to the yarn downstream of the rollers, the swing support including a movable member in contact with the yarn to bring the latter into engagement with the driving roller, and a fixed stop member arranged for limiting the movement of the movable member in order to release the yarn from the engagement with the feed driving roller, and a second yarn brake arranged downstream of the swing support. The arrangement of the feeding device of this invention makes it possible to use a single set of feed driving rollers for a plurality of yarns.

With preference, the stationary stop member as well as the movable member of the swing support are provided with clamping surfaces between which the yarn is guided. In this manner it is achieved that each individual yarn which is loaded by the swing support is positively withdrawn from the yarn bobbin but that all other yarns where the moving members of the swing support rest on the stop member are without load and, therefore, the yarns are not in a frictional engagement with the circumference of the feed driving roller. Consequently, it is made possible that with a single driving arrangement a band of yarns having different processing speeds are positively withdrawn and individually fed to the processing part of the machine.

In a modification of this arrangement, the swing support is formed by a rocking lever rotatable about a pivot point and having its free end provided with a rotary disk cooperating with two stop bars. In another embodiment, the swing support is in the form of a wire yoke suspended on the yarn and cooperating with a fixed stop bar. According to still another feature of this invention, the braking force of the second yarn brake is larger than the pulling force applied to each yarn by the movable member of the swing support.

The device according to this invention insures that yarns which are subject to different tensions are individually withdrawn from the assigned bobbins and in the range of the feed driving rollers the tension is released to a value approaching zero so that there is always maintained a reserve portion on the yarn and by the action of the second yarn brake all yarns are subjected to a well-defined uniform tension under which they are fed into the loop forming part of the textile machine.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
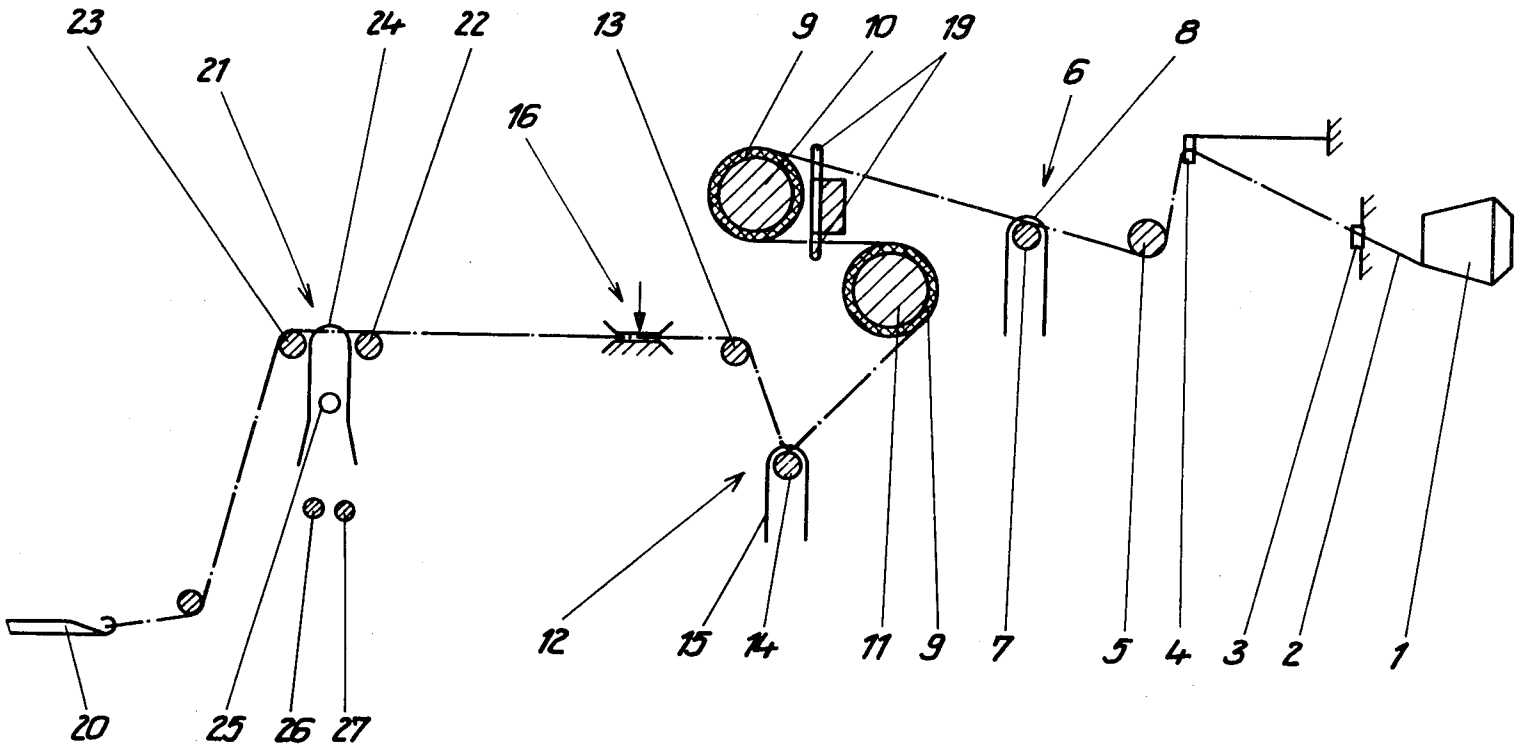
FIG. 1 is a schematic side view of the yarn feeding device of this invention.

Referring firstly to FIG. 1 the device for feeding yarns into a textile machine includes a bobbin 1 from which yarn 2 is wound off. The yarn 2 passes through a guide eyelet 3, a yarn guard 4, a deviation rod 5 and through the first yarn brake 6 in the form of a fixed rod 7 arranged below the yarn 2 and a wire yoke 8 resting on the yarn above the stop rod 7.

Figure 2:
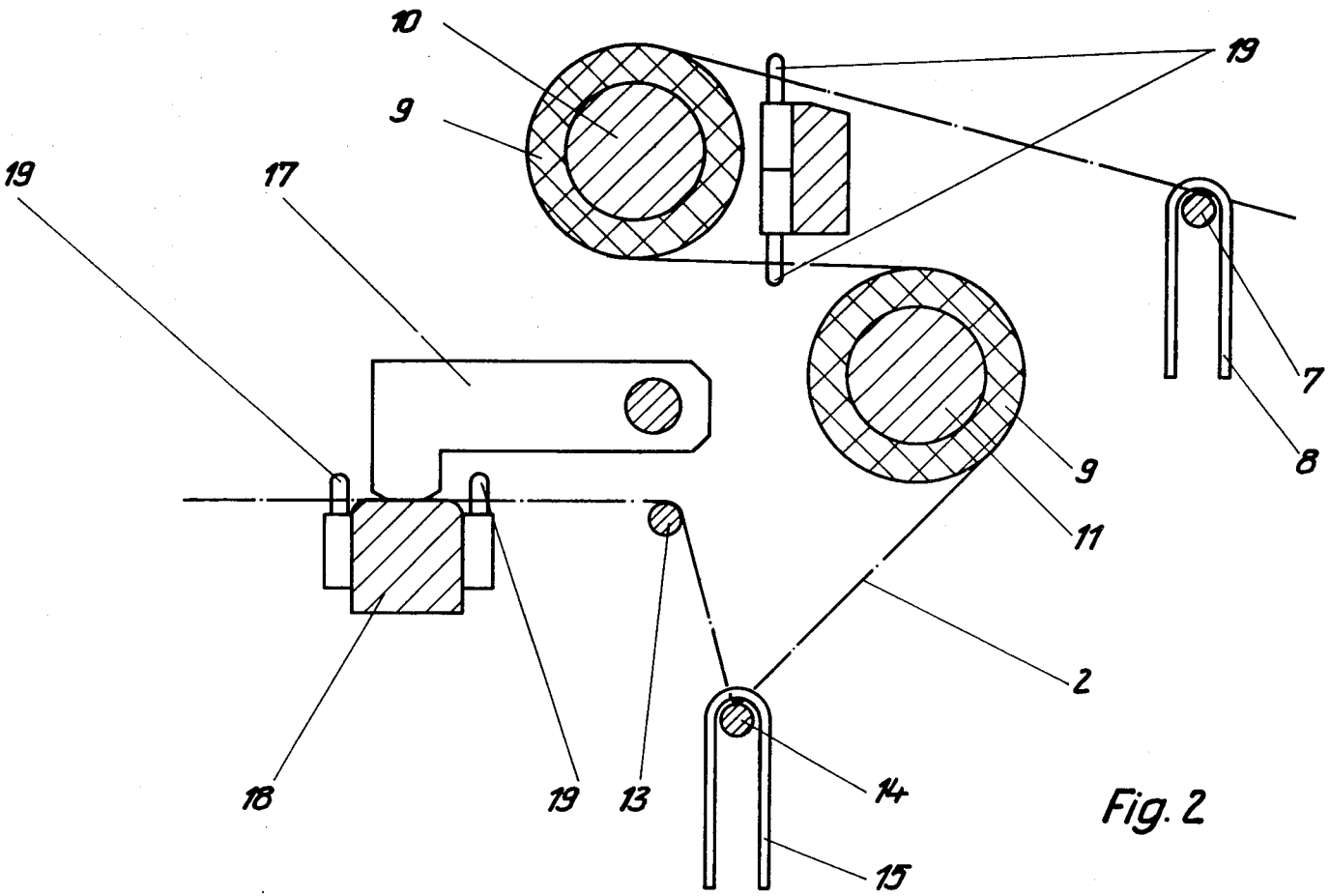
FIG. 2 shows a variation of the second yarn brake in the device of this invention.

From the first yarn brake the yarn 2 is guided past circumferential portions of two feed driving rollers 10 and 11 coated with frictional rubber lining 9 and downstream of the driving rollers it passes through a first single yarn swing support 12 which in this embodiment is formed of a stationary or fixed stop bar 14 below the yarn and of a wire yoke 15 suspended on the yarn 2 to move above the stop bar 14. The swing support 12 is located between and below the second feed driving roller 11 and an additional deviation rod 13. Downstream of the deviation rod 13 is arranged a second yarn brake 16 assigned for each individual yarn 2. In the preferred embodiment of the second yarn brake as illustrated in FIG. 2, there is provided for each yarn 2 a narrow rocking lever 17 the free end of which cooperates with a stop bar 18. Guide reeds 19 are arranged for guiding individual yarns downstream of respective feed driving rollers 10 and 11 and on both sides of the stop bar 18 of the second yarn brake. A second single yarn swing support 21 is arranged between the processing needles 20 and the second yarn brake 16. The second swing support 21 in this embodiment is assembled of two deviation rods 22 and 23 and of a wire yoke 24 suspended on the yarn between the stop rods. The arms of the yoke 24 in the second swing support 27 are guided by a guide bar 25 and below these arms are arranged two electrical contact rails 26 and 27 which are short-circuited by the yoke 24 when the latter is accidentally disengaged from the yarn.

As mentioned above, the yarn 2 is wound off the bobbins 1 and passes through guide eyelet 3 and through a yarn guard 4 which in the event of an increased yarn tension resulting from cross windings on the bobbin or from released and knotted windings in the range of the bobbin switch off the machine and thus prevent the yarn 2 from breakage. The feed driving rollers 10 and 11 are partially looped by the yarn 2 and rotate with a circumferential speed which is higher than the maximum feeding speed of the yarn into the loop forming part of the machine. The tensioned yarn 2 is advanced by the holding friction resulting between the rubber lining 9 and the yarn. Upstream of the driving rollers 10 and 11 the yarn is continuously subject to a braking force exerted by the first yarn brake 6 which force is slightly larger than the sliding friction between the rubber lining 9 and the tensionless yarn 2. The sliding friction only takes place between an unloaded or tensionless yarn 2 and the driving rollers 10 and 11. The braking force in the first yarn brake 6 is determined by the weight of the wire yoke 8 supported on the yarn or by the condition of the contact surfaces between the rod 7 and the yoke 8.

As soon as a minute pulling force is exerted on the yarn downstream of the driving rollers 10 and 11, the sliding friction between the rubber lining 9 and the yarn 2 is immediately changed into a holding friction which amplifies the pulling force upstream of the driving rollers. This increased pulling force overcomes the braking force of the first yarn brake 6 and withdraws the yarn 2 from the bobbin 1.

The minute pulling force downstream of the driving rollers is generated by the first swing support 12, in this example by the weight of the wire yoke 15 when the latter does not rest on its stop 14.

Downstream of the deviation rod 13 of the first swing support 12 each yarn 2 passes through a second yarn brake 16 which as illustrated in FIG. 2 is preferably an additive yarn brake and made of a swingably supported narrow lever 17 which below its hammer-like free head portion abuts against a stop bar 18. The yarns lie on the stop bar 18 and the head of the lever 17 compresses the yarn 2 from above against the bar 18 so that the yarns are continually braked. To insure that levers 17 abut against all individual yarns, the hammer-like heads of the lever 17 are provided with flat guiding grooves in which the yarns 2 are guided. Subsequently each yarn 2 passes through the second swing support 21 including in this embodiment a wire yoke 24 which acts simultaneously as a yarn guide or monitor. The wire yokes 24 hang on respective yarns 2 and equalize the tension variations occurring during a loop-forming cycle between the needles 20 and the second yarn brake 16.

The braking force of the second yarn brake 16 is higher than the pulling force exerted by the yokes in the first and the second swing supports 12 and 21 so that the latter are separated to act as two independent systems. It is possible to adjust the braking force by changing the mass of the lever 17 pressing against the yarns 2 by means of shiftable weights or by changing the length of the lever by means of an adjustable pivot point.

If yarn 2 breaks at the downstream end of the device, the wire yoke 24 falls on the lower guide bar 25 and short-circuits with its arms the electrical contact rails 26 and 27. A control circuit connected to the contact rails is thus closed and switches off the machine. During the loop-forming process, needles 20 pull the requisite yarns 2 through the second yarn brake 16 whereby the reserve portion of the yarn 2 formed by the second swing supports 21 between the second yarn brake 16 and the needle 20 is processed first. Then the yarn portion upstream of the yarn brake 16 causes a momentary lift of the wire yoke 15 from the stop bar 14. As a consequence, a pulling force exerted by the weight of the yoke 15 is applied also in the direction of the feed driving rollers 10 and 11 and such a minute load causes the yarn 2 to fully engage the rubber lining 9 of the rollers 10 and 11 and the resulting holding friction between the lining and the yarn overcomes the braking force of the first yarn brake 6 and the yarn is advanced at a higher speed by the rotating rollers 10 and 11.

The minute load of the yarn 2 by the weight of the wire yoke 15 is amplified by the frictional forces of the driving rollers to such an extent that the resulting pulling force acting on the yarn 2 is sufficient to insure a reliable decoiling of the yarn from the bobbins 1 irrespective of different frictional forces resulting from different working conditions and from different feeding paths of relatively long yarns. If the yarn tension is too high, the yarn safeguard 4 is brought into action to prevent the breakage of the yarn. As soon as driving rollers 10 and 11 have advanced the yarn 2 about a length which causes the wire yoke 15 of the swing support 12 to abut against the stop bar 14 the yarn is released from the weight of the yoke 15 and no pulling tension is applied against the rubber lining 9 of the roller and the loose sliding friction takes place again. As a consequence, the braking force of the first yarn brake 6 prevents the yarn from decoiling from the bobbin 1.

Figure 3:
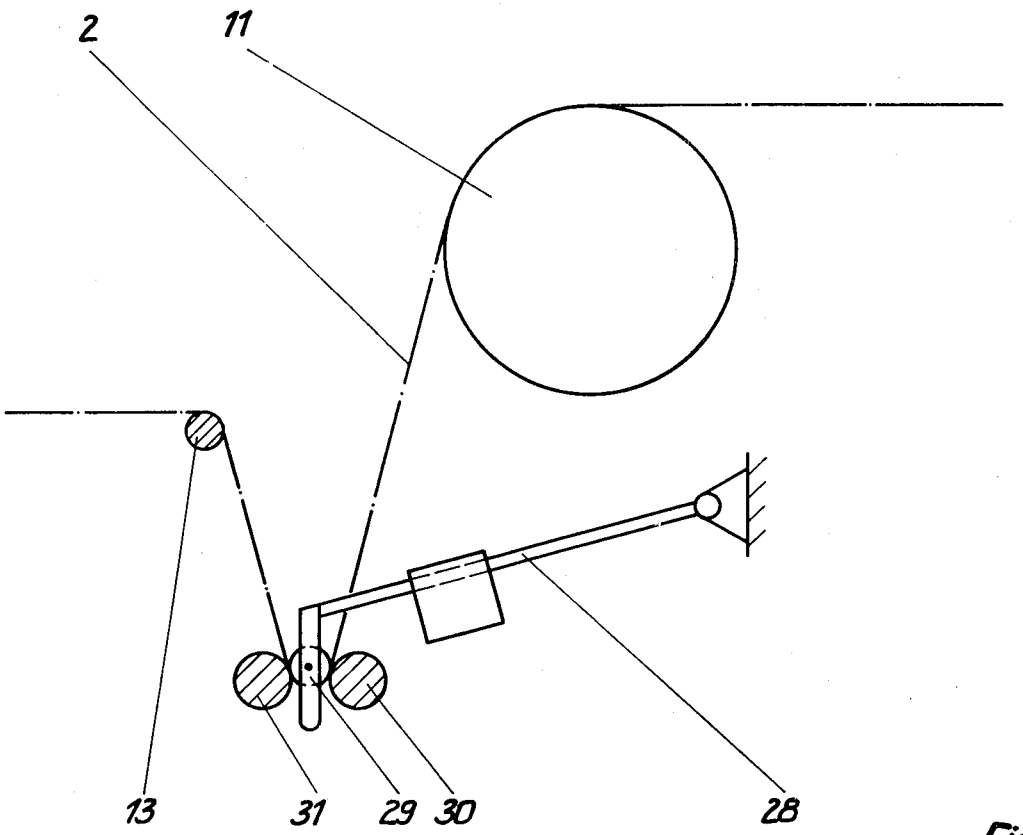
FIG. 3 shows schematically a modification of the yarn swing support in the device of this invention.

The single yarn swing support 12 can be made in different forms. In the modification as shown in FIG. 3, for example, the movable wire yoke 15 is replaced by a weight loaded or spring loaded rocking lever 28. The free end of the lever 28 is bent and supports for rotation a disk 29 which engages the yarn 2. The stop member in this embodiment is formed of two rods 30 and 31 spaced apart from one another about a distance which permits the abutment of the rotating disk 29 together with the yarn so that two clamping points or surfaces result between the stop rods 31 and 30 and the yarn on the rotating disk 29.

It will be understood that each of the elements described above, or two or more together, may also find a useful application in other types of constructions differing from the types described above.

While the invention has been illustrated and described as embodied in a yarn feeding device for textile machines, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A device for feeding yarn in a textile machine, comprising at least one driving roller rotating at a circumferential speed exceeding the processing speed of the yarn in the machine; means for guiding said yarn around a circumferential portion of the driving roller; a first yarn brake arranged upstream of said roller; a first swing support arranged downstream of said roller and including a movable member in contact with said yarn to apply by its weight a tension on said yarn sufficient to bring the latter into a frictional engagement with the circumference of said driving roller, and a fixed stop member arranged for limiting the movement of said movable member to release said yarn from the tension applied by said movable member and thus to disengage the yarn from said frictional engagement with said driving roller; and a second yarn brake arranged downstream of said first swing support.

2. The device as defined in claim 1, wherein said feed driving roller is assigned to a plurality of yarns whereby said first yarn brake and said first swing support is provided for each yarn.

3. The device as defined in claim 2, further including a second single yarn swing support arranged between said second yarn brake and the yarn processing part of the machine.

4. The device as defined in claim 1, wherein said first swing support includes a rocking lever pivotable about a fixed pivot point and cooperating with a pair of stop members to form two clamping surfaces for said yarn.

5. The device as defined in claim 1, wherein said moving member of said first swing support is a wire yoke suspended on said yarn and cooperating with the stop member in the form of a fixed rod.

6. The device as defined in claim 1, wherein said second yarn brake is in the form of an additive yarn brake.

7. The device as defined in claim 1, wherein said second yarn brake is in the form of a gripper brake.

8. The device as defined in claim 1, wherein said second yarn brake includes a rocking lever arranged above said yarn and a stop bar below said yarn.

9. The device as defined in claim 1, wherein the braking force of said second yarn brake is larger than the tension exerted by the moving member of said first swing support.

10. The device as defined in claim 3, wherein said second swing support includes a movable member in the form of a wire yoke suspended on each yarn and cooperating with a pair of electrical contact rails arranged below said yarn and connected to an electrical circuit for the machine.

* * * * *